US005385811A

United States Patent [19]

Hirano

[11] Patent Number: 5,385,811

[45] Date of Patent: Jan. 31, 1995

[54] METHOD FOR PROCESSING SILVER HALIDE PHOTOGRAPHIC MATERIALS

[75] Inventor: Mitsunori Hirano, Kanagawa, Japan

[73] Assignee: Fuji Photo Film Co., Ltd., Kanagawa, Japan

[21] Appl. No.: 234,921

[22] Filed: Apr. 28, 1994

[30] Foreign Application Priority Data

Apr. 27, 1993 [JP] Japan ..... 5-122151

[51] Int. Cl.[6] ..... G03C 5/305

[52] U.S. Cl. ..... 430/438; 430/439; 430/445; 430/446; 430/481; 430/487; 430/488; 430/490

[58] Field of Search ..... 430/438, 439, 440, 442, 430/445, 446, 464, 486, 487, 488, 489, 490, 523, 963, 481, 482, 483

[56] References Cited

U.S. PATENT DOCUMENTS 3,512,981 5/1970 Prehal et al. ..... 430/265
3,865,591 2/1975 Katz ..... 430/437
4,232,117 11/1980 Naoi et al. ..... 430/523

FOREIGN PATENT DOCUMENTS

WO9312463 6/1993 WIPO .

*Primary Examiner*—Hoa Van Le
*Attorney, Agent, or Firm*—Sughrue, Mion, Zinn, Macpeak & Seas

[57] ABSTRACT

A method for processing silver halide photographic material is disclosed, which has a support thereon at least one silver halide emulsion layer and at least one protective layer provided over said emulsion layer in which each of the photographic materials contains colloidal silica in at least one emulsion layer and is at most 200% in the total swelling degree of the whole hydrophilic colloid layers provided on the side of said emulsion layer, and after optical exposure said photographic materials are developed with a developer adjusted to pH 9.5-12.0 and containing at least (1) a hydroquinone developing agent in a concentration of from 0.2 to 0.75 mole/l, (2) an auxiliary developing agent of 1-phenyl-3-pyrazolidone type and/or an auxiliary developing agent of p-aminophenol type in a concentration of from 0.001 to 0.06 mole/l, (3) free sulfite ions in a concentration of from 0.3 to 1.2 mole/l, (4) a compound represented by the following formula (I), and (5) a compound represented by the following formula (II) in a concentration bearing a ratio of from 0.03 to 0.12 to the concentration of the hydroquinone developing agent:

(I)

(II)

wherein the above substituents are defined in the specification.

8 Claims, No Drawings

METHOD FOR PROCESSING SILVER HALIDE PHOTOGRAPHIC MATERIALS

BACKGROUND OF THE INVENTION

1. Field of the Invention

The present invention relates to a method for processing silver halide photographic materials and, more particularly, to a processing method for silver halide photographic materials having high suitability for rapid processing which ensures reduction in silver stain (or silver sludge) and color stain.

2. Prior Art

The graphic arts industry is strongly desirous of an improvement in operating efficiency and an increase in operation speed. Accordingly, there are comprehensive needs for the scanning operation to be speeded up and for the processing time of a photosensitive material to be shortened.

In order to meet these needs in the graphic arts, it is desirable for an exposure apparatus (including a scanner and a plotter) to increase its scanning speed, and further not only to increase the number of its scanning lines but also to converge its scanning beams with intention of enhancing the image quality. On the other hand, it is desirable for a silver halide photographic material to have high sensitivity, high stability and high suitability for rapid photographic processing.

The term "rapid photographic processing" as used herein refers to the processing in which it takes 15 to 100 seconds for the top of a photographic film to travel from the insertion slit of an automatic developing machine to the exit of the drying part of the machine via the developing tank, the transit part, the fixing tank, the transit part, the washing tank and the drying part in succession.

In order to render a photographic material suitable for rapid processing and to effect the rapid photographic processing thereof, it is necessary to increase a developing speed and a fixing speed and to shorten a drying time. As a means for achieving such purposes, it is effective to reduce the contents of gelatin used as a binder in emulsion layers and protective layers. In particular, reduction in thickness of protective layers is required. As a result, the photographic material faces a serious pressure-fog problem.

As a means for lessening the density change caused by pressure, it is known to adopt, e.g., the method of adding a polymer latex or a plasticizer such as a polyhydric alcohol, the method of reducing a silver halide/gelatin ratio in the silver halide emulsion layer, the method of increasing the thickness of a protective layer or the method of adding a lubricant or colloidal silica to a protective layer for the purpose of lightening the pressure before it reaches silver halide grains.

However, the addition of a plasticizer is restricted in the amount used since it lowers the mechanical strength of the emulsion layer, while the reduction of the silver halide/gelatin ratio and the increase in thickness of the protective layer retard the progress of development to impair the rapid-processing suitability of the photographic material. Further, the addition of colloidal silica or the like to a protective layer is insufficient onto the prevention of the change in image density due to pressure.

In addition, it is also effective to increase the amount of a hardener added to a silver halide photographic material. According to this method, the photographic material can have improved resistance to damage by pressure because its swelling degree in a developer can be reduced, but it suffers from an increase of color stain.

On the other hand, resources, produced gases, waste water, other various wastes and so on, have been reinspected in many fields from the standpoint of environmental preservation. In the field of photographic processing, there are growing needs for reduction in replenishment rates of processing solutions used for processing photographic materials in view of saving resources, reduction in amount of waste water, reduction in volume of vessels used, and so on.

However, reduction in replenishment rate of a developer causes an increase of silver sludge. The thus generated silver deposit adheres to the developing tank, the rollers and other parts of an automatic developing machine, and further transfer onto photographic materials processed in the developing machine to damage their image quality.

For the purpose of decreasing such silver stain, the methods of reducing the amount of silver ion eluted and/or adding such compounds as to inhibit silver ions from being reduced to silver are disclosed in JP-A-56-24347 (the term "JP-A" as used herein means an "unexamined published Japanese patent application"), JP-B-56-46585 (the term "JP-B" as used herein means an "examined Japanese patent publication"), JP-B-62-2849 and JP-A-04-362942. Those methods suffice for the prevention of silver stain in case the developer has a reduced replenishment rate, but cannot ensure satisfactory aerial-oxidation resistance to the developer.

The addition of ascorbic acid to a developer is known. In many cases, ascorbic acid is used as developing agent, as disclosed, e.g., in U.K. Patents 956,368, 1,030,495 and 1,380,309, U.S. Pat. Nos. 3,821,000 and 2,688,549, and JP-B-36-17599. Since these patents use ascorbic acid as a developing agent and the developers used therein do not contain any hydroquinone derivatives, the effect of ascorbic acid in the present invention is away from those patents. Moreover, ascorbic acid is liable to be hydrolyzed through aerial oxidation when the amount added to an alkali developer is increased beyond 0.15 M. The hydrolysis of ascorbic acid lowers the pH of the developer to result in a lowering of the developer's activity.

The patents relating to the combined use of a hydroquinone derivative and ascorbic acid in a developer are also disclosed. For instance, there can be cited U.S. Pat. No. 3,512,981, JP-B-55-49298, U.K. Patents 1,326,495 and 1,266,533, JP-B-44-28673 and U.K. Patent 1,365,236. More specifically, these patents concern the lith type developing systems for the field of photomechanical processes. However, those developing systems are low in free sulfite ion concentration, so that their stability is poor. That is, they are undesirable from the standpoint of preservation of the developer. Further, the combined use of a hydroquinone derivative and ascorbic acid in a single bath developer is disclosed in U.S. Pat. No. 3,806,344, West German Patent 2,549,683, and so on. However, the purpose of using such developers is different from that of the present developer. The combined use of a hydroquinone derivative, ascorbic acid and a 1-phenyl-3-pyrazolidone derivative in a developer is disclosed in U.S. Pat. No. 3,865,591. The ascorbic acid used therein functions as a developing agent; moreover, the specification of the above-cited patent is silent on the effect of ascorbic acid which is revealed by the present invention. Furthermore, the developer of that patent is low in development activity because the pH range thereof is low. Therefore, it is also different in purpose from the present developer.

SUMMARY OF THE INVENTION

An object of the present invention is to provide a method for processing silver halide photographic materials, which enables the silver halide photographic materials to have reduced color stain even when they have suitability for rapid processing and the generation of silver sludge in a developing tank and/or on a development rack and rollers.

The foregoing object is attained with the present processing method described below.

The present method for processing silver halide photographic materials is characterized in that, after exposure, silver halide photographic materials having on a support at least one silver halide emulsion layer and at least one protective layer provided over said emulsion layer, each of said photographic materials containing colloidal silica in at least one emulsion layer and being at most 200% in the total swelling degree of the whole hydrophilic colloid layers provided on the side of said emulsion layer, are developed with a developer adjusted to pH 9.5–12.0 and containing at least (1) a hydroquinone developing agent in a concentration of from 0.2 to 0.75 mole/l, (2) an auxiliary developing agent of 1-phenyl-3-pyrazolidone and/or an auxiliary developing agent of p-aminophenol in a concentration of from 0.001 to 0.06 mole/l, (3) free sulfite ions in a concentration of from 0.3 to 1.2 mole/l, (4) a compound represented by the following formula (I), and (5) a compound represented by the following formula (II) in a concentration bearing a ratio of from 0.03 to 0.12 to the concentration of the hydroquinone developing agent:

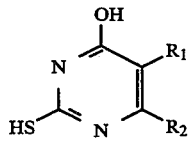

(I)

wherein $R_1$ and $R_2$ each represents a hydrogen atom, an alkyl group, an aryl group, an aralkyl group, a hydroxyl group, a mercapto group, a carboxyl group, a sulfo group, a phosphono group, an amino group, a nitro group, a cyano group, a halogen atom, an alkoxycarbonyl group, an aryloxycarbonyl group, a carbamoyl group, a sulfamoyl group or an alkoxy group, or $R_1$ and $R_2$ may combine with each other to complete a ring structure;

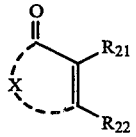

(II)

wherein $R_{21}$ and $R_{22}$ each represents a hydroxy group, an amino group, an acylamino group, an alkylsulfonylamino group, an arylsulfonylamino group, an alkoxycarbonylamino group, a mercapto group or an alkylthio group, and X is constituted of carbon, oxygen or/and nitrogen atoms and forms a 5- or 6-membered ring together with the vinyl group's two carbon atoms to which $R_{21}$ and $R_{22}$ are attached and the carbonyl group's carbon atom.

Now, the compounds represented by formula (I) are described in detail.

In formula (I), it is desirable that either $R_1$ or $R_2$ be an alkyl group containing 1 to 10 carbon atoms which may have a substituent, an aryl group containing 6 to 12 carbon atoms which may have a substituent, an aralkyl group containing 7 to 12 carbon atoms which may have a substituent, a nitro group, a cyano group or a halogen atom. The total number of carbon atoms contained in $R_1$ and $R_2$ is preferably in the range of 2 to 20. In addition, it is also desirable that $R_1$ and $R_2$ combine with each other to complete a saturated 5- or 6-membered ring.

More desirably, $R_1$ is a hydrogen atom or an alkyl group containing an amino group or a heterocyclylic group as a substituent, while $R_2$ is an alkyl group containing 1 to 10 carbon atoms which may have a substituent or an aryl group containing 6 to 12 carbon atoms which may have a substituent; or $R_1$ and $R_2$ are moieties completing a saturated 5- or 6-membered ring by combining with each other. Specific examples of $R_1$ include dimethylaminomethyl group, morpholinomethyl group, N-methylpiperazinylmethyl group and pyrrolidinylmethyl group. As for $R_2$, on the other hand, methyl group, ethyl group, phenyl group, p-methoxyphenyl group and the like are specific examples thereof.

Specific examples of the compound represented by formula (I) are illustrated below. However, the invention should not be construed as being limited to these compounds.

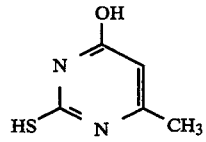

I-1

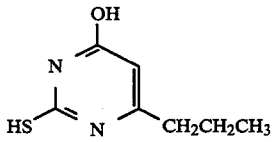

I-2

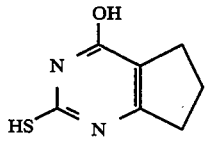

I-3

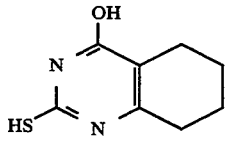

I-4

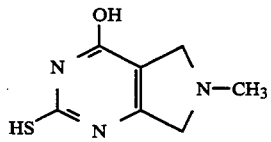

I-5

-continued

I-6

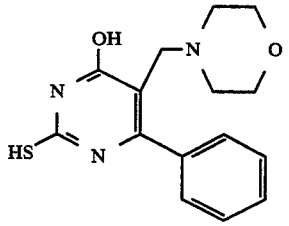

I-7

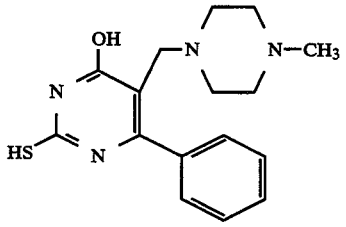

I-8

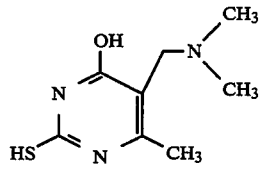

I-9

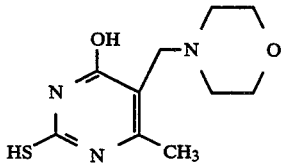

I-10

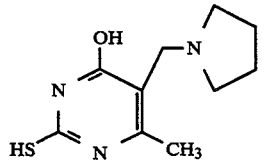

I-11

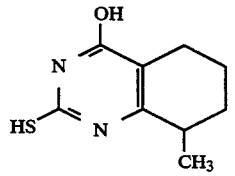

I-12

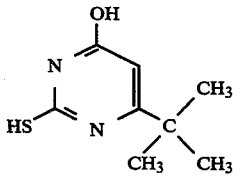

I-13

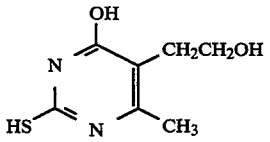

-continued

I-14

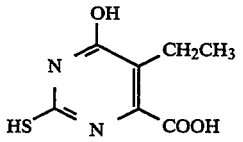

The above-illustrated compounds can be easily prepared using well-known conventional methods. Literatures to refer to about the preparation methods thereof are *Comprehensive Heterocyclic Chemistry*, volume 3, pages 40–56, pages 106–142 and pages 179–192, and *The Journal of American Chemical Society*, volume 67, pages 2197–2200 (1945).

The compound of formula (I) is preferably added in an amount of from 0.01 to 100 m mole per liter of the developer, more preferably from 0.1 to 10 m mole per liter of the developer.

Next the compounds represented by formula (II) are described in detail.

In formula (II), $R_{21}$ and $R_{22}$ each represents a hydroxy group, an amino group, an acylamino group, an alkylsulfonylamino group, an arylsulfonylamino group, an alkoxycarbonylamino group, a mercapto group or an alkylthio group, and X represents atoms completing a 5- or 6-membered ring together with the two vinyl group's carbons and the carbonyl group's carbon.

More specifically, $R_{21}$ and $R_{22}$ each represents a hydroxy group, an amino group (including those substituted with one or two $C_{1-10}$ alkyl groups, such as methyl, ethyl, n-butyl, hydroxyethyl, etc.), an acylamino group (such as acetylamino, benzoylamino, etc.), an alkylsulfonylamino group (e.g., methanesulfonylamino, etc.), an arylsulfonylamino group (e.g., benzenesulfonylamino, p-toluenesulfonylamino, etc.), alkoxycarbonylamino (e.g., methoxycarbonylamino, etc.), a mercapto group, or an alkylthio group (e.g., methylthio, ethylthio, etc.). Among the above-cited groups, those preferred as $R_{21}$ and $R_{22}$ are a hydroxy group, an amino group, an alkylsulfonylamino group and an arylsulfonylamino group.

X is constituted of carbon, oxygen or/and nitrogen atoms, and complete a 5- or 6-membered ring together with the two vinyl group's carbons and the carbonyl group's carbon. Specific examples of X include those formed by combining any two or three moieties chosen from —O—, —C($R_3$)($R_4$)—, —C($R_5$)=, —C(=O)—, —N($R_6$)— and —N=. Herein, $R_3$, $R_4$, $R_5$ and $R_6$ each represents a hydrogen atom, a $C_{1-15}$ alkyl group (which may be substituted with a hydroxy group, a carboxyl group, a sulfo group or so on), a $C_{6-15}$ aryl group (which may be substituted with an alkyl group, a halogen atom, a hydroxy group, a carboxyl group, a sulfo group or so on), a hydroxy group or a carboxyl group. Further, the 5- or 6-membered ring completed by X may form a condensed ring by being fused together with a saturated or unsaturated 5- or 6-membered ring.

Specific examples of the foregoing 5- or 6-membered ring include a dihydrofuranone ring, dihydropyrone ring, a pyranone ring, a cyclopentenone ring, a cyclohexenone ring, a pyrrolinone ring, a pyrazolinone ring, a pyridone ring, an azacyclohexenone ring and an uracil ring. Of these rings, a dihydrofuranone ring, a cyclopentenone ring, cyclohexenone ring, a pyrazolidone ring, an azacyclohexenone ring and an uracil ring are preferred.

Specific examples of the present compound of general formula (II) are illustrated below. However, the present invention should not be construed as being limited to these compounds.
II-1
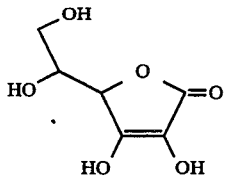
II-2
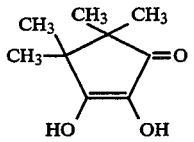
II-3
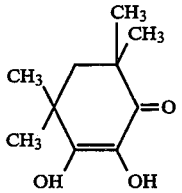
II-4
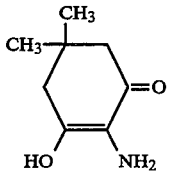
II-5
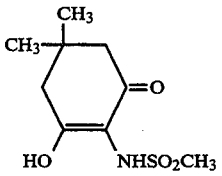
II-6
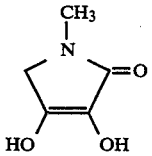
II-7
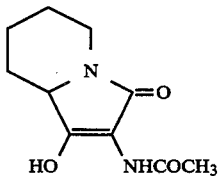
II-8
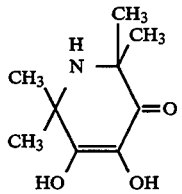
-continued
II-9
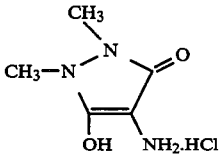
II-10
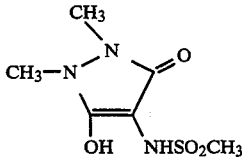
II-11
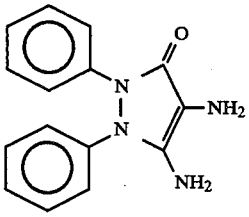
II-12
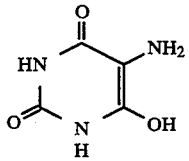
II-13
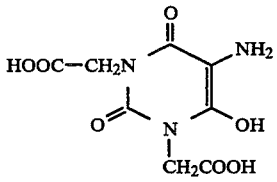
II-14
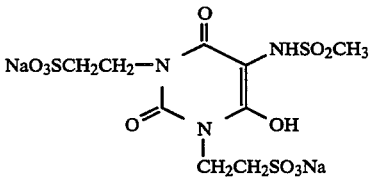
II-15
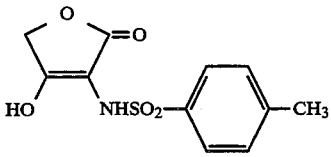
II-16
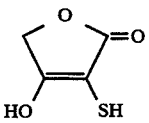
II-17
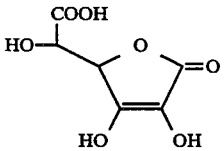

-continued

II-18

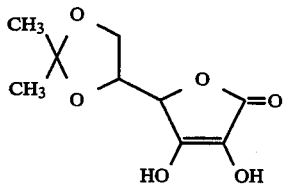

II-19

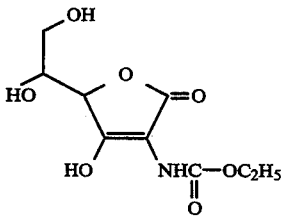

II-20

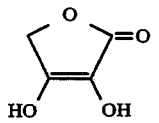

II-21

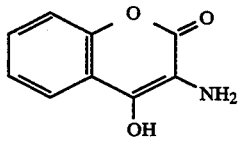

II-22

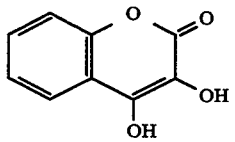

Of these compounds, ascorbic acid or erythorbic acid (its stereoisomer), namely Compound (II-1), is the most preferable. As for the addition amount of a compound represented by formula (II), it is desirable that the ratio of the concentration of the compound of formula (II) to that of a hydroquinone developing agent (or the quotient of the concentration of the compound of formula (II) divided by the concentration of a hydroquinone developing agent) be in the range of 0.03 to 0.12, preferably 0.03 to 0.10, particularly preferably 0.05 to 0.09.

Specific examples of a hydroquinone developing agent used in the present invention include hydroquinone, chlorohydroquinone, bromohydroquinone, isopropylhydroquinone, methylhydroquinone, 2,3-dibromohydroquinone, 2,5-dimethylhydroquinone. Of these hydroquinones, a hydroquinone is preferred in particular. The concentration of a hydroquinone derivative in a developer ranges from 0.2 to 0.75 mole/l, preferably from 0.2 to 0.5 mole/l, and particularly preferably from 0.2 to 0.4 mole/l.

Specific examples of a 1-phenyl-3-pyrazolidone developing agent used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone. Of these 1-phenyl-3-pyrazolidone derivatives, 1-phenyl-3-pyrazolidone and 1-phenyl-4-methyl-4-hydroxymethyl-3-pyrazolidone are preferred in particular.

Specific examples of a p-aminophenyl developing agent used in the present invention include N-methyl-p-aminophenol, p-aminophenol, N-(β-hydroxyethyl)-p-aminophenol and N-(4-hydroxyphenyl)glycine. Of these compounds, N-methyl-p-aminophenol is preferred.

When dihydroxybenzenes are used in combination with 1-phenyl-3-pyrazolidones or p-aminophenols, it is desirable that the amount of the former be in the range of 0.05 to 0.5 mole per liter of the developer and that of the latter be not more than 0.06 mole per liter of the developer.

The developer for development-processing of the present invention uses free sulfite ion as a preservative. In incorporating free sulfite ion in the developer, it is added to the developer in the form of sodium sulfite, lithium sulfite, ammonium sulfite, sodium hydrogen sulfite or the like. The free sulfite ion concentration in the developer is in the range of 0.3 to 1.2 mole/l, preferably 0.4 to 1.0 mole/l, and particularly preferably 0.5 to 0.8 mole/l.

The pH of the developer used in the development-processing of the present invention is controlled to the range of 9.5 to 12.0, preferably 9.7 to 11.9. An alkali agent used for adjustment of pH include a pH adjusting agent such as sodium hydroxide, sodium carbonate, sodium tertiary phosphate, potassium hydroxide, potassium carbonate, etc.

It is desirable that the developer be free from borates used as a buffer, because the borates generally complex with the ascorbic acid derivatives of formula (II).

The developer used in the present processing method can contain a hardener of dialdehyde type or the bisulfite adducts thereof, if desired. Specific examples of such a hardener include glutaraldehyde, α-methylglutaraldehyde, β-methylglutaraldehyde, maleindialdehyde, succindialdehyde, methoxysuccindialdehyde, methylsuccindialdehyde, α-methoxy-β-ethoxyglutaraldehyde, α-n-butoxyglutaraldehyde, 60 ,α-diethylsuccindialdehyde, butylmaleindialdehyde and the bisulfite adducts of these dialdehydes. Of these compounds, glutaraldehyde and its bisulfite adduct are most prevailingly used. The dialdehyde compounds as cited above are used in an amount such that they may not retard the photographic speed of the emulsion layers processed and may not prolong the drying time to a considerable extent. Specifically, the hardener of dialdehyde type is used in an amount of from 1 to 50 g, preferably from 3 to 10 g, per liter of the developer.

The developer used in the present method contains an antifoggant, such as that of indazole, benzimidazole or benzotriazole type. Specific examples of such an antifoggant include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazole-2-yl)thio]-butanesulfonate,5-amino-1,3,4-thiadiazole-2-thiol, and so on. The amount of these antifoggants added is generally in the range of 0.01 to 10 mmol, preferably 0.1 to 2 mmol, per liter;of the developer. In addition to these organic antifoggants, halides such as potassium bromide, sodium bromide and the like can also be used.

Further, various kinds of organic and inorganic chelating agents can be used in the developer of the present invention. Suitable examples of an inorganic chelating agent which can be used include sodium tetrapolyphosphate, sodium hexametaphosphate and the like.

As for the organic chelating agent which can be used, on the other hand, organic carboxylic acids, aminopolycarboxylic acids, organic phosphonic acids, aminophosphonic acids and organic phosphonocarboxylic acids are typical examples thereof.

More specifically, such organic carboxylic acids include acrylic acid, oxalic acid, malonic acid, succinic acid, glutaric acid, adipic acid, pimelic acid, cork acid, azelaic acid, sebacic acid, nonanedicarboxylic acid, decanedicarboxylic acid, undecanedicarboxylic acid, maleic acid, itaconic acid, malic acid, citric acid, tartaric acid and so on. However, those usable in the developer should not be construed as being limited to these acids.

Such aminopolycarboxylic acids as mentioned above include iminodicarboxylic acid, nitrilotriacetic acid, nitrilotripropionic acid, ethylenediaminomonohydroxyethyltriacetic acid, ethylenediaminetetraacetic acid, glycolethertetraacetic acid, 1,2-diaminopropanetetraacetic acid, diethylenetriamine-pentaacetic acid, triethylenetetraminehexaacetic acid, 1,3-diamino-2-propanoltetraacetic acid, glycoletherdiamino-tetraacetic acid, and the compounds disclosed, e.g., in JP-A-52-25632, JP-A-55-67747, JP-A-57-102624 and JP-B-53-40900.

Organic phosphonic acids as mentioned above include the hydroxyalkylidene-diphosphonic acids disclosed, e.g., in U.S. Pat. Nos. 3,214,454, 3,794,591 and West German Patent Publication (OLS) 2,227,639, and the compounds described in Research Disclosure, Volume 181, Item 18170 (May, 1979).

Aminophosphonic acids as mentioned above include aminotris(methylenephosphonic acid), ethylenediaminotetramethylenephosphonic acid, aminotrimethylenephosphonic acid, and further the compounds disclosed, e.g., in *Research Disclosure*, supra, Item 18170, JP-A-57-208554, JP-A-54-61125, JP-A-55-29883 and JP-A-56-97347.

Organic phosphonocarboxylic acids as mentioned above include the compounds disclosed, e.g., in JP-A-52-102726, JP-A-53-42730, JP-A-54-121127, JP-A-55-4024, JP-A-55-4025, JP-A-55-126241, JP-A-55-65955, JP-A-55-65956, and *Research Disclosure*, supra, Item 18710.

Those chelating agents may be used in the form of alkali metal or ammonium salts. The amount of chelating agents used is preferably in the range of $1\times10^{-4}$ to $1\times10^{-1}$ mole, particularly $1\times10^{-3}$ to $1\times10^{-2}$ mole, per liter of the developer.

In addition to the above-described ingredients, the developer used in the present method can contain, if needed, buffers (e.g., carbonates, alkanol amines), alkali agents (e.g., hydroxides, carbonates), dissolution aids (e.g., polyethylene glycols, esters thereof), pH adjusters (e.g., organic acids such as acetic acid), development accelerators (e.g., various pyridinium compounds and other cationic compounds, cationic dyes such as phenosafranine, and neutral salts such as thallium nitrate and potassium nitrate, as disclosed in U.S. Pat. No. 2,648,604, JP-B-44-9503 and U.S. Pat. No. 3,171,247; the nonionic compounds disclosed in JP-B-44-9304 and U.S. Pat. Nos. 2,533,990, 2,531,832 and 2,577,127, including polyethylene glycol and derivatives thereof, polythioethers and so on; the organic solvents disclosed in JP-B-44-9509 and Belgian Patent 682,862; and the thioether compounds disclosed in U.S. Pat. No. 3,201,242: especially the thioether compounds), surfactants and so on.

A suitable temperature and a suitable time for development-processing are correlated with each other, and determined in connection with the total processing time. In general, the development temperature ranges from about 20° C. to about 50° C., and the development time is in the range of 10 seconds to 2 minutes.

In developing 1 $m^2$ of a black-and-white silver halide photographic material, the amount of a replenisher used is at most 700 ml, preferably at most 500 ml.

Subsequently to the development step, fixation-processing is carried out.

A fixer used in the fixation step of the present invention is an aqueous solution containing sodium thiosulfate or ammonium thiosulfate, and further, if needed, tartaric acid, citric acid, gluconic acid, boric acid or/and salts thereof. The pH of the fixer is generally in the range of about 3.0 to about 7.0, preferably 3.5 to 7.0, and particularly preferably 3.8 to 6.0. Among those ingredients, sodium thiosulfate or ammonium thiosulfate functions as fixing agent. The amount of a thiosulfate used ranges from 0.5 to 2.0 mole, preferably from 0.7 to 1.6 mole, and particularly preferably from 1.0 to 1.5 mole, per liter of the fixer.

The fixer can optionally contain a hardener (e.g., water-soluble aluminum compounds), a preservative (e.g., sulfites, hydrogen sulfites), a pH buffer (e.g., acetic acid, boric acid), a pH adjuster (e.g., ammonia, sulfuric acid), a chelating agent, a surfactant, a wetting agent and a fixation accelerator. Examples of a surfactant which can be used include anionic surfactants such as sulfates, sulfonates, etc., polyethylene type surfactants and the amphoteric surfactants disclosed in JP-A-57-6840. Further, a defoaming agent may be contained therein. As for the wetting agent which can be used, alkanolamines and alkylglycols are examples thereof. Examples of a fixation accelerator which can be used include the thiourea derivatives and alcohols containing a triple bond in their individual molecules, as disclosed in JP-B-45-35754, JP-B-58-122535 and JP-B-58-122536; the thioether compounds disclosed in U.S. Pat. No. 4,126,459; and the meso ion compounds disclosed in JP-A-04-229860. As pH buffers, there can be used organic acids such as acetic acid, malic acid, succinic acid, tartaric acid, citric acid and the like, and inorganic buffers such as boric acid, phosphates, sulfites and so on. Herein, inorganic buffers are preferred to organic ones from the standpoint of inhibiting the fixer from giving off bad odors and the processing equipment from rusting. Those pH buffers are used in order to prevent the pH of the fixer from rising due to the developer brought in the fixer. The amount of the pH buffer used is in the range of about 0.1 to about 1.0 mole, preferably about 0.2 to about 0.6 mole, per liter of the fixer.

As for the hardener in the fixer used in the present invention, water-soluble aluminum salts and chromium salts are examples thereof. However, those preferred as the hardener are water-soluble aluminum salts, with specific examples including aluminum chloride, aluminum sulfate and chrome alum. The fixation temperature and time are preferably chosen from the range of 5 seconds to 1 minute at about 20° C. to about 50° C. The replenishment rate of the fixer is at most 700 ml/$m^2$, preferably at most 500 ml/$m^2$.

The thus developed and fixed photographic materials are subjected to a washing or stabilization operation. It is possible to perform the washing or stabilization step at a replenishment rate of below 3 liter per $m^2$ of the silver halide photographic material (including 0 l/$m^2$, that is a washing with stagnant water). The reduced replenishment in the washing step enables the saving of water, while no replenishment therein can dispense with a pipe arrangement in setting up the automatic developing machine. In case where the washing step is carried out with a small amount of water, it is preferable to dispose the cleanup tank equipped with squeeze rollers disclosed, e.g., in JP-A-63-18350 and JP-A-62-287252. In order to reduce in pollution loading which becomes an issue when a small amount of water is use for washing, various oxidizing agents may be added and a filtration procedure may be incorporated in the washing step. In the present method, it is further possible to utilize part or all of overflow of washing water or stabilizer in the processing solution having fixability which is used in the step prior to the washing or stabilization step, as disclosed in JP-A-60-235133. Therein, the overflow is generated by replenishing the washing or stabilizing bath with the water, for which an moldproof means is used, in proportion to the progress of the processing. Furthermore, it is possible to add a water-soluble surfactant and a defoaming agent to the washing or stabilizing bath in order to prevent bubble marks, which tend to generate in the washing step using a small amount of water, and/or transfer of ingredients adhering to squeeze rollers onto the processed films. In addition, the dye adsorbers disclosed in JP-A-63-163456 may be added into the washing tank for the purpose of prevention of the contamination with dyes eluted from photographic materials.

On the other hand, the above-described washing step can be succeeded by a stabilization step. For instance, the baths containing the compounds disclosed in JP-A-02-201357, JP-A-02-132435, JP-A-01-102553 and JP-A-46-44446 may be used as the final bath for the photographic materials. The stabilizing bath also can contain ammonium compounds, compounds of metals such as Bi, Al, etc., fluorescent brightening agents, various chelating agents, film pH adjusters, hardeners, bactericides, antimolds, alkanolamines and surfactants, if desired. As for the water used for the stabilizing bath, not only city water but also deionized water and water sterilized with halogens, an UV sterilization lamp, various oxidizing agents (e.g., ozone, hydrogen peroxide, chlorates) or so on, can be used to advantage.

The silver halide used in the present invention may be any of silver chloride, silver bromide, silver iodide, silver chlorobromide, silver chloroiodide, silver iodobromide, silver chloroiodobromide and so on. Among these silver halides, silver chloroiodobromide, silver chlorobromide and silver iodobromide are preferred. In particular, silver chlorobromide and silver chloroiodobromide having an iodide content of at most 1 mol % are used to advantage.

As for the average grain size, it is preferable that the silver halide used in the present invention be fine grains (e.g., those having an average grain size of 0.7 μm or less), particularly 0.5 μm or less in average grain size. As to the distribution of sizes among grains, there is no particular restriction. However, it is preferable for the silver halide grains to be a monodisperse system with respect to size distribution. The term "a monodisperse system" as used herein means the system in which at least 95% by weight or number of the constituent grains have their individual sizes within the range of ±40% of the average grain size.

The silver halide grains in photographic emulsions may have a regular crystal form, such as that of a cube or an octahedron; an irregular crystal form, such as that of a sphere, a tabular form or so on; or a composite form thereof.

The interior and the surface of the silver halide grains may differ, or the silver halide grains may be uniform throughout. Two or more kinds of silver halide emulsions prepared separately may be used in the form of mixture.

Further, the silver halide emulsion layer may be a single layer or a multiple layer (e.g., a double layer, a triple layer, etc.). In case of the multiple layer, different silver halide emulsions may be used in the constituent layers respectively, or the same silver halide emulsion may be used therein.

In a process of producing silver halide grains to constitute the silver halide emulsions used in the present invention or of allowing the produced silver halide grains to ripen physically, cadmium salts, lead salts, thallium salts, rhodium salts or complexes, iridium salts or complexes, and/or the like may be present.

In the present invention, it is desirable to use water-soluble rhodium salts, the representatives of which are rhodium chloride, rhodium trichloride, rhodium ammonium chloride and the like. Also, complex salts of rhodium can be used. The time to add these rhodium salts is limited to the period prior to the conclusion of the first ripening step in the emulsion-making process. In particular, it is desirable to add them during formation of the grains. Their addition amount is preferably in the range of $1\times10^{-8}$ to $1\times10^{-6}$ mole per mole of silver.

The silver halides especially suited to be used in the present invention are those prepared in the presence of from $10^{-8}$ to $10^{-5}$ mole/mole Ag of a single or complex salt of iridium.

It is also desirable that the foregoing amount of iridium salt be added before the conclusion of physical ripening of silver halide grains, especially during formation of the grains, in a process of producing silver halide emulsions.

Iridium salts which can be used therein are water-soluble iridium salts or iridium complex salts. Specific examples of such salts include iridium trichloride, iridium tetrachloride, potassium hexachloroiridate(III), potassium hexachloroiridate(IV) and ammonium hexachloroiridate(III).

As for the binder or protective colloid used for photographic emulsions, gelatin is used to advantage. Of course, hydrophilic colloids other than gelatin can be used. Specific examples of such colloids include proteins such as gelatin derivatives, graft polymers of gelatin with other high molecular compounds, albumin, casein, etc.; cellulose derivatives such as hydroxyethyl cellulose, carboxymethyl cellulose, cellulose sulfate; sugar derivatives such as sodium alginate; starch derivatives, etc.; and various kinds of synthetic hydrophilic high molecular substances including homo-and copolymers, such as polyvinyl alcohol, partial acetals of polyvinyl alcohol, poly-N-vinylpyrrolidone, polyacrylic acid, polymethacrylic acid, polyacrylamide, polyvinylimidazole, polyvinylpyrazole, etc.

The silver halide emulsions used in the present invention may or may not be chemically sensitized. Known methods for the chemical sensitization include sulfur sensitization, selenium sensitization, reduction sensitization and precious metal sensitization methods. These methods can be used independently or as a combination thereof.

One of representatives of noble metal sensitization methods is a gold sensitization method in which gold compounds, mainly gold complex salts, are used. In the gold sensitization, complex salts of noble metals other than gold, such as platinum, palladium, iridium and the like, may be used together.

As for the sulfur sensitizer used in the sulfur sensitization method, there can be used not only sulfur compounds contained in gelatin but also various kinds of sulfur compounds including thiosulfates, thioureas, thiazoles and rhodanines.

As for the reduction sensitizers used in the reduction sensitization method, there can be used stannous salts, amines, formamidinesulfinic acid, silane compounds and so on.

As for the selenium sensitizers used in the selenium sensitization method, there can be used the selenium compounds well-known in various patents. More specifically, the selenium sensitization is usually effected by adding a selenium compound of unstable type and/or a selenium compound of non-unstable type to an emulsion and then by stirring the resulting emulsion for a definite time at a high temperature, preferably not lower than 40° C. Suitable examples of a selenium compound of unstable type include the compounds disclosed in JP-B-44-15748, JP-B-43-13489, JP-A-4-25832 and JP-A-4-109240.

The photographic materials of the present invention can contain the compounds disclosed in JP-A-60-140340 and JP-A-61-167939 for the purpose of increasing their photographic speed and ensuring high contrast in the photographic images. These compounds may be used alone or as a mixture of two or more thereof.

The photographic materials of the present invention can further contain a wide variety of compounds for the purpose of preventing fog or stabilizing photographic properties during production, storage or photographic processing thereof. Specifically, they can contain azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketo compounds such as oxazolinethione; azaindenes, such as triazaindenes, tetraazaindenes (especially 4-hydroxy-substituted (1,3,3a,7)-tetraazaindenes), pentaazaindenes, etc.; and any compounds which have been known as antifoggant or stabilizer, such as benzenethiosulfonic acid, benzenesulfinic acid, benzenesulfonamide, etc. Of the above-cited compounds, benzotriazoles (e.g., 5-methylbenzotriazole) and nitroindazoles (e.g., 5-nitroindazole) are favored in particular. Also, these compounds may be contained in a processing solution.

The light-sensitive silver halide emulsions of the present invention may be spectrally sensitized with sensitizing dyes so as to have sensitivities to blue light of relatively longer wavelengths, green light, red light or infrared light. As for the sensitizing dyes which can be used, cyanine dyes, merocyanine dyes, complex cyanine dyes, complex merocyanine dyes, holopolar cyanine dyes, styryl dyes, hemicyanine dyes, oxonol dyes and hemioxonol dyes are examples thereof.

More specifically, the sensitizing dyes used to advantage in the present invention are those disclosed, e.g., in *Research Disclosure*, Item 17643 Clause IV-A (December 1978, page 23), ibid, Item 1831, Clause X (August 1978, page 437), and the references quoted therein.

In particular, it is advantageous to choose the sensitizing dyes from those having spectral sensitivities suitable for spectral characteristics of scanner light sources of various types.

For instance, there can be chosen to advantage (A) the simple merocyanines disclosed in JP-A-60-162247, JP-A-02-48653, U.S. Pat. No. 2,161,331 and West German Patent 936,071 in case of an argon laser light source; (B) the trinuclear cyanine dyes disclosed in JP-A-50-62425, JP-A-54-18726 and JP-A-59-102229 in case of a He—Ne laser light source; (C) the thiacarbocyanines disclosed in JP-B-48-42172, JP-B-51-9609, JP-B-55-39818 and JP-A-62-284343 in case of an LED light source; (D) the tricarbocyanines disclosed in JP-A-59-191032 and JP-A-60-80841, the 4-quinoline nucleus-containing dicarbocyanines disclosed in JP-A-59-192242 and so on in case of a semiconductor laser light source.

Those sensitizing dyes may be used individually or in combination. Combinations of sensitizing dyes are often employed for the purpose of supersensitization. Materials which can exhibit a supersensitizing effect in combination with a certain sensitizing dye although they themselves to not spectrally sensitize silver halide emulsions or do not absorb light in the visible region may be incorporated in the silver halide emulsions.

Useful sensitizing dyes, supersensitizing combinations of dyes and materials capable of exhibiting a supersensitizing effect are described in *Research Disclosure*, volume 176, Item 17643 (December 1978), page 23, Clause IV-J.

As for the content of sensitizing dyes in each of the silver halide emulsions used in the present invention, it is desirable that the optimum be determined depending upon the grain size and the halogen composition of the silver halide emulsion, the method adopted in chemical sensitization of the silver halide emulsion and the extent of chemical sensitization achieved thereby, the relation between the layer in which the sensitizing dyes are incorporated and the silver halide emulsion, and the species of the antifogging compounds used. Procedures for determining the optimum are well known to those skilled in the arts. In general, the optimal amount of sensitizing dyes used is in the range of $10^{-7}$ to $1\times10^{-2}$ mole, particularly $10^{-6}$ to $5\times^{-3}$ mole, per mole of silver halide.

As for the binder of the present silver halide emulsion layers and the present protective layers, gelatin is used. Of course, hydrophilic colloids other than gelatin can be used. Specific examples of such colloids include proteins such as gelatin derivatives, graft polymers prepared from gelatin and other high molecular compounds, albumin, casein, etc.; cellulose derivatives such as hydroxyethyl cellulose, carboxymethyl cellulose, cellulose sulfate; sugar derivatives such as sodium alginate, starch derivatives, etc.; and various kinds of synthetic hydrophilic high molecular substances including homo- and copolymers, such as polyvinyl alcohol, partial acetals of polyvinyl alcohol, poly-N-vinylpyrrolidone, polyacrylic acid, polymethacrylic acid, polyacrylamide, polyvinylimidazole, polyvinylpyrazole, etc.

As for the gelatin, not only lime-processed gelatin but also acid-processed gelatin may be used. In addition, hydrolysis products of gelatin and enzymatic degradation products of gelatin can also be used.

In order to ensure rapid processing suitability and high dimensional stability for the present photographic materials, it is preferable to minimize the coverage rate of gelatin as binder. In particular, the gelatin coverage of a protective layer has a great influence on the developing speed and the fixing speed. The total of gelatin coverage rates of the whole constituent layers, including silver halide emulsion layers, influences the drying speed and the dimensional stability. Therefore, it is desirable that the gelatin coverage rate of the present protective layer(s) be not higher than 1.0 g/m$^2$, preferably in the range of 0.15 to 0.4 g/m$^2$, while the total of gelatin coverage rates of the whole constituent layers arranged on the emulsion layer side of the support be not higher than 5 g/m$^2$, preferably from 1.5 to 4.0 g/m$^2$.

It is practical for the present silver halide photographic material that the whole hydrophilic colloid layers provided on the emulsion layer side, including their emulsion layers and protective layers, have a total swelling degree of at most 200%. Preferably, the total swelling degree ranges from 50 to 150%.

It turns out that the total swelling degrees greater than 200% not only lower wet film strength but also tend to be responsible for a jamming trouble in the drying part of an automatic developing machine. On the other hand, the total swelling degrees below 50% retard development and fixation, and have bad influences upon photographic properties.

In the present invention, the total swelling degree of hydrophilic colloid layers is determined as follows:

There is measured the thickness ($d_o$) of the whole hydrophilic colloid layers, including emulsion layers and protective layers, which constitute the present silver halide photographic material. Then, the silver halide photographic material is dipped in 25° C. distilled water for one minute, whereby it swells. The thickness after the swelling ($\Delta d$) is measured. The total swelling degree is calculated using the following equation;

$$\text{Total Swelling Degree } (\%) = \Delta d \div d_o \times 100.$$

The thickness can be measured using the same principle as an electric micrometer described in JIS B7536. For instance, the measurement can be performed with an electronmicrometer (Model K306) made by Anritsu Electric Co., Ltd.

As a practical method for arbitrarily controlling the swelling degree of hydrophilic layers including silver halide emulsion layers and protective layers, there can be adopted the method of using inorganic or organic gelatin hardeners individually or in combination. Specific examples of such hardeners which can be desirably used include active vinyl compounds (e.g., 1,3,5-triacryloyl-hexahydro-s-triazine, bis(vinylsulfonyl)methyl ether, N,N'-methylenebis[$\beta$-(vinylsulfonyl)propionamide), active halogen-containing compounds (e.g., 2,4-dichloro-6-hydroxy-s-triazine), mucohalogenic acids (e.g., mucochloric acid), and N-carbamoylpyridinium salts (e.g., 1-morpholinocarbonyl-3-pyridinomethylene)pyrrolidinium-2-naphthalenesulfonate). These compounds can be used alone or as a mixture of two or more thereof. In particular, the active vinyl compounds disclosed in JP-A-53-41220, JP-A-53-57257, JP-A-59-162546 and JP-A-60-80846 and the active halogen-containing compounds disclosed in U.S. Pat. No. 3,325,287 are preferably used.

For the purpose of improving the pressure resistance without accompanied by a drop in sensitivity, it is desirable in the present invention that colloidal silica and a polyhydroxybenzene compound be added to a silver halide emulsion layer and/or a layer other than the emulsion layers.

Colloidal silica used in the present invention has an average grain size of from 5 m$\mu$ to 1,000 m$\mu$, preferably from 5 m$\mu$ to 500 m$\mu$, and contains silicon dioxide as a major component and optionally alumina or sodium aluminate as a minor component. Further, such colloidal silica may contain as a stabilizer an inorganic base such as sodium hydroxide, potassium hydroxide, lithium hydroxide or ammonia, or an organic base such as tetramethylammonium ion.

As for the colloidal silica, those disclosed in JP-A-53-112732, JP-B-57-009051 and JP-B-57-051653 are examples thereof.

More specifically, the colloidal silica of commercial origin, e.g., Snowtex 20 ($SiO_2/Na_2O \geqq 57$), Snowtex 30 ($SiO_2/Na_2O \geqq 50$), Snowtex C ($SiO_2/Na_2O \geqq 100$) and Snowtex O ($SiO_2/Na_2O \geqq 500$l), which are the products of Nissan Chemicals Industries, Ltd. (Tokyo, Japan), can be used in practice. The $SiO_2/Na_2O$ ratio set forth above refers to the ratio of the content (by weight) of silicon dioxide to the content (by weight) of sodium hydroxide calculated in terms of $Na_2O$, and the numerical values thereof are those described in sale brochure.

The suitable ratio of colloidal silica used in the present invention to gelatin used as a binder in the layer, to which the colloidal silica is added, ranges from 0.05 to 1.0, particularly preferably from 0.1 to 0.6, on a dry weight basis.

Polyhydroxybenzene compounds which can be used in the present invention include those disclosed in JP-A-2-216138, from page 60, line 10, to page 64, line 10.

It is desirable in the present invention that the kinematic friction coefficient ($\mu_k$) of the outermost layer be not greater than 0.35, and preferably ranges from 0.10 to 0.35.

Typical examples of a lubricant which can be used include the lubricant of silicone type disclosed, e.g., in U.S. Pat. No. 3,042,522, U.K. Patent 955,061, U.S. Pat. Nos. 3,080,317, 4,004,927, 4,047,958 and 3,489,567, and U.K. Patent 1,143,118; the lubricants of higher fatty acid, alcohol and acid amide types disclosed, e.g., in U.S. Pat. Nos. 2,454,043, 2,732,305, 2,976,148 and 3,206,311, German Patents 1,284,295 and 1,284,294; the metal soaps disclosed, e.g., in U.K. Patent 1,263,722 and U.S. Pat. No. 3,933,516; the lubricants of ester and ether types disclosed, e.g., in U.S. Pat. Nos. 2,588,765 and 3,121,060, and U.K. Patent 1,198,387; the lubricants of taurine type disclosed in U.S. Pat. Nos. 3,502,473 and 3,042,222; and the colloidal silica of the above-described compositions.

As the lubricant used in the present invention, those preferred are the alkylpolysiloxanes disclosed in JP-A-60-188945, liquid paraffins which are liquid at room temperature, and anionic surfactants.

The ratio of the lubricant to the binder in the outermost layer ranges from 0.01 to 1.0, preferably from 0.01 to 0.5, by weight. In particular, the range of 0.05 to 0.1 is preferred as the foregoing ratio.

When an anionic surfactant is used as lubricant, the coverage thereof is preferably in the range of 0.001 to 0.5 g/m$^2$, particularly 0.01 to 0.2 g/m$^2$.

It is desirable in the present invention that the protective layer be constituted of two or more layers. When a silver halide photosensitive material is preserved under a low humidity condition, it has a defect that its hydrophilic colloid layers in a film becomes brittle. For the purpose of obviating this defect, it is desirable to incorporate a polymer latex having a glass transition point (Tg) of no higher than 20° C. into an emulsion layer and/or a protective layer. When the protective layer is constituted for preference of two or more layers, it is desirable to incorporate a polymer latex into an interlayer arranged between an emulsion layer and the outermost layer from the standpoint of preventing the film from becoming brittle without weakening the film strength in processing solutions and without causing the adhesion trouble between sensitive materials under a high humidity condition.

As for the polymer latex which can be incorporated in the protective layer of the present invention, examples thereof are hydrates of vinyl polymers, such as acrylate polymers, methacrylate polymers, styrene polymers and the like, including those disclosed in U.S. Pat. Nos. 2,772,166, 3,325,286, 3,411,911, 3,311,912 and 3,525,620, and *Research Disclosure*, No. 195, Item 19551 (July, 1980).

Specific examples of polymer latexes having Tg of no higher than 20° C., which are used to advantage in the present invention, include the homopolymer of an alkylacrylate such as methylacrylate, ethylacrylate, butylacrylate or the like, the copolymer of an alkylacrylate and acrylic acid, N-methylolacrylamide or so on (wherein the fraction of a comonomer, such as acrylic acid, etc., is preferably at most 30 wt %), the homopolymer of butadiene, the copolymer of butadiene and one or more of a monomer chosen from among styrene, butoxymethylacrylamide and acrylic acid, the terpolymer of vinylidene chloride, methylacrylate and acrylic acid, and so on.

In determining the Tg of a polymer latex, a method of using differential scanning calorimetric analysis (DSC) can be adopted.

The average particle size of a polymer latex used in the present invention is preferably in the range of 0,005 to 1 μm, particularly 0.02 to 0.1 μm.

The polymer latex is preferably added in a proportion of 5 to 200% by weight, particularly 10 to 100% by weight, to the hydrophilic colloid contained in the layer to which it is added.

Above and/or below the emulsion layer of the present invention, there is preferably provided, a light-insensitive hydrophilic colloid layer dyed with dyes (hereinafter referred to as a dyed layer) for the purposes of the prevention of halation and improvements in safety under safelight and distinguishability between the front and back surfaces.

For the dyes to be incorporated into the hydrophilic colloid layer which is intended to be dyed, it is necessary to meet the requirements such that;

(1) their spectral absorption is suitable for the end-use purpose, (2) they are inert from the standpoint of photographic chemistry (that is, they don't have any chemically adverse effects upon characteristics of silver halide photographic emulsion layers and, more specifically, they don't cause the lowering of sensitivity, the fading of latent images, the generation of fog, and so on), (3) they are decolored in the course of photographic processing or eluted into a processing solution or washing water, whereby they don't remain as undesirable color stain in the photographic material after photographic processing, (4) they don't diffuse from the layer intended to be dyed therewith into other layers, and (5) their stabilities in solutions and photographic materials are so high as not to cause any change in color or discoloration with a lapse of time. Suitable examples of a dyeing method which can fulfil the above-described requirements include the method of adsorbing dyes to mordants, as disclosed, e.g., in U.S. Pat. Nos. 3,455,693, 2,548,564, 4,124,386 and 3,625,694, JP-A-47-13935, JP-A-55-33172, JP-A-56-36414, JP-A-57-161853, JP-A-52-29727, JP-A-61-198148, JP-A-61-177447, JP-A-61-217039 and JP-A-61-219039; the method of using nondiffusible dyes, as disclosed, e.g., in JP-A-61-213839, JP-A-63-208846, JP-A-63-296039 and JP-A-01-158439; the method of emulsifying dyes dissolved in oil to disperse them as oil droplets, as disclosed in JP-A-01-142688; the method of adsorbing the dyes to the surface of an inorganic material, as disclosed, e.g., in U.S. Pat. Nos. 2,496,841 and 2,496,843, JP-A-60-45237 and U.S. Pat. No. 2,719,088, 5,079,134; the method of adsorbing dyes to polymers, as disclosed in JP-A-02-298939; and the method of using water-insoluble dyes as they are in a state of solid, as disclosed, e.g., in JP-A-56-12639, JP-A-55-155350, JP-A-55-155351, JP-A-63-27838, JP-A-63-197943, European Patents 15,601, 274,723, 276,566 and 299,435, WO 88/047, and U.S. Pat. No. 5,098,818. Of these methods, the method of dispersing dyes as they are in a state of solid is preferred from the standpoints of fixing the dyes to an intended layer and enabling reduction in color stain after photographic processing.

As for the dyes which can be used in the dyed layer of the present invention, the microcrystalline dispersion of at least one compound selected from those disclosed in JP-A-04-14035, on pages 6 to 14, is preferred.

The dyes used in the present invention can be synthesized with ease using or according to the methods disclosed in WO 88/04794, EP-A1-0274723, EP-A1-0276566, EP-A1-0299435, JP-A-52-92716, JP-A-55-155350, JP-A-55-155351, JP-A-61-205934, JP-A-48-68623, U.S. Pat. Nos. 2,527,583, 3,486,897, 3,746,539, 3,933,798, 4,130,429, 4,040,841 and 5,063,146, JP-A-02-282244, EP-A-0430186, and so on.

The term "microcrystalline dispersion" as used herein means a condition such that dyes cannot be present in a molecular state in a layer intended to be dyed therewith because they themselves are insufficient in solubility but they are present as solid particles having a size large enough to make the diffusion inside the layer substantially impossible.

The methods of preparing such a microcrystalline dispersion are disclosed in WO 88/04794, EP-A-1-0276566, JP-A-63-197943 and so on. Specifically, the method which can be generally used comprises grinding dyes with a ball mill and then stabilizing the ground dyes with a surfactant and gelatin.

It is desirable that the microcrystals of the dyes used in the present invention have a grain size of no greater than 1.0 μm, particularly no greater than 0.5 μm.

The amount of such dyes used is preferably in the range of 5 to 300 mg/m$^2$, particularly 10 to 150 mg/m$^2$.

As for the binder used in the dyed layer of the present invention, the same binders as used in the above-described emulsion and the protective layers are used to advantage. The dyed layer can have a gelatin coverage properly chosen so that the coverage of whole gelatin used in the present invention (excluding gelatin used for BC layers) can be controlled to 10 g/m$^2$ or less. Preferably, the gelatin coverage of the dyed layer ranges from 0.05 to 2.0 g/m$^2$.

The photographic emulsion layers and other hydrophilic colloid layers of the present photographic material may contain various kinds of surfactants as disclosed in JP-A-03-109542, from page 59, line 1, to page 60, line 18, for various purposes, e.g., as a coating aid, for prevention of static-charge generation, for emulsifying dispersion, for prevention of adhesion, and for improvements in photographic characteristics (such as acceleration of development, increase in contrast, sensitization, etc.).

For the purpose of preventing the adhesion trouble, the present photographic material can further contain a matting agent, such as silica, magnesium oxide, polymethylmethacrylate, etc., in the photographic emulsion layers and other hydrophilic colloid layers.

The photographic material of the present invention can contain a water-insoluble or slightly soluble synthetic polymer dispersion for the purpose of improvement in dimensional stability and so on. Suitable examples of such a polymer include those containing as constituent monomers an alkyl(metha)acrylate, an alkoxyalkyl(metha)acrylate, a glycidyl(metha)acrylate, a (metha)acrylamide, a vinyl ester (e.g., vinyl acetate), an acrylonitrile, an olefin, a styrene and so on individually or in combination of two or more thereof, or in combination with acrylic acid, methacrylic acid, an $\alpha,\beta$-unsaturated dicarboxylic acid, a hydroxyalkyl(metha)acrylate, a sulfoalkyl(metha)acrylate, a styrenesulfonic acid or so on.

In the photographic materials of the present invention, various additives can be used according to the end-use purposes thereof. Such additives are described in detail in *Research Disclosure*, Volume 176, Item 17643 (December, 1978) and ibid, Volume 187, Item 18716 (November, 1979), and pages on which they are described are summarized in the following table.

| Kind of Additive | RD 17643 | RD 18716 |
|---|---|---|
| 1. Chemical Sensitizer | p. 23 | p. 648, right column |
| 2. Sensitivity Increasing Agent | | p. 648, right column |
| 3. Spectral Sensitizer and Supersensitizing Agent | pp. 23–24 | p. 648, right column, to p. 649, right column |
| 4. Brightening Agent | p. 24 | |
| 5. Antifoggant and Stabilizer | pp. 24–25 | p. 649, right column |
| 6. Light Absorbent, Filter Dye, and Ultraviolet Absorbent | pp. 24–26 | p. 649, right column, and p. 650, left column |
| 7. Stain Inhibitor | p. 25, right column | p. 650, from left to right column |
| 8. Dye Image Stabilizer | p. 25 | |
| 9. Hardener | p. 26 | p. 651, left column |
| 10. Binder | p. 26 | p. 651, left column |
| 11. Plasticizer and Lubricant | p. 27 | p. 650, right column |
| 12. Coating Aid and Surfactant | pp. 26–27 | p. 651, right column |
| 13. Antistatic Agent | p. 27 | p. 651, right column |

As for the support which can be used for the present photographic materials, a light-reflecting flexible support such as a paper laminated with an $\alpha$-olefin polymer (e.g., polyethylene, polypropylene, ethylene-butene copolymer), a synthetic paper, etc., a film of semisynthetic or synthetic polymer such as cellulose acetate, cellulose nitrate, polystyrene, polyvinyl chloride, polyethylene terephthalate, polycarbonate, polyamide, etc., a flexible support constituted of the above-cited film and a light-reflecting layer, a metal foil and so on, are examples thereof. Of these support materials, a polyethylene terephthalate film is preferred in particular. Suitable examples of a subbing layer which can be used include the subbing layers disclosed in JP-A-49-3972, which are formed by treatment with the organic solvent containing polyhydroxybenzenes, and the subbing layers disclosed, e.g., in JP-A-49-11118 and JP-A-52-104913, which are formed by treatment with aqueous latexes, and so on. In general, the surfaces of those subbing layers can further be treated chemically or physically. Specific examples of such a treatment include surface activating treatments such as the treatment with chemical agents, mechanical treatments, corona discharge treatment, and so on. The present invention can be applied to various kinds of photosensitive materials, such as sensitive materials for graphic arts, sensitive materials for X-ray photography, negative photographic materials for amateur use, reversal photographic materials for amateur use, positive photographic materials for amateur use, direct-positive photographic materials, and so on.

It is desirable that the processing solutions used in the present invention be preserved using a packing material having low oxygen-permeability as disclosed in JP-A-61-73147. When the replenishment rate is reduced, it is desirable to prevent the processing solutions from evaporating and suffering aerial oxidation by lessening the air-contacted areas of the processing tanks. Automatic developing machines of carrier roller type are disclosed, e.g., in U.S. Pat. Nos. 3,025,779 and 3,545,971. In the present invention, such machines are simply referred to as carrier roller-type processors. Those carrier roller-type processors are constituted of four operation parts, namely development, fixation, washing and drying parts. In the present invention also, it is most suitable for the photographic processing to follow in the foregoing operation steps, though other operation steps (e.g., a stop operation step) are not excluded.

The present invention will now be illustrated in more detail by reference to the following examples, which are not to be construed as limiting the scope thereof. Unless otherwise indicated, all parts, percents and ratio are by weight.

EXAMPLE 1

Emulsion Layer

<Preparation of Emulsion A>

| | |
|---|---|
| Solution I: | |
| Water | 1,000 ml |
| Gelatin | 20 g |
| Sodium Chloride | 20 g |
| 1,3-Dimethylimidazolidine-2-thione | 20 mg |
| Sodium Benzenethiosulfonate | 8 mg |
| Solution II: | |
| Water | 400 ml |
| Silver Nitrate | 100 g |
| Solution III: | |
| Water | 400 ml |
| Sodium Chloride | 27.1 g |
| Potassium Bromide | 21 g |

-continued

| | |
|---|---|
| Potassium Hexachloroiridate(III) (0.001% aqueous solution) | 15 ml |
| Ammonium Hexabromorhodate(III) (0.001% aqueous solution) | 1.5 ml |
| Solution IV: | |
| Water | 400 ml |
| Silver Nitrate | 100 g |
| Solution V: | |
| Water | 400 ml |
| Sodium Chloride | 27.1 g |
| Potassium Bromide | 21 g |
| Potassium Hexacyanoferrate(III) (0.1% aqueous solution) | 5 ml |

To the solution I which was maintained at 38° C. and pH 4.5, the solutions II and III were simultaneously added over a 10-minute period with stirring, thereby forming the grain core measuring 0.16 μm in size. Thereto, the solutions IV and V were further added over a 10-minute period, thereby forming the grain shell. Furthermore, 0.15 g of potassium iodide was admixed therewith to complete the grain formation.

The thus obtained emulsion was washed with water in a conventional manner, specifically using a flocculation method, and then 30 g of gelatin was added thereto.

The resulting emulsion was adjusted to pH 5.3 and Pag 7.5, and thereto were added 2.6 mg of sodium thiosulfate, 1.0 mg of triphenylphosphinselenide and 6.2 mg of chloroauric acid, and further added 4 mg of sodium benzenethiosulfonate and 1 mg of sodium benzenesulfinate. The chemical sensitization by the addition of these compounds was carried out at 55° C. so as to achieve the maximum sensitivity.

Furthermore, the chemically sensitized emulsion was admixed with 200 mg of 4-hydroxy-6-methyl-1,3,3a,7-tetraazaindene as a stabilizer and phenoxyethanol as antiseptics. Thus, a silver chlorobromide cubic grain emulsions having a chloride content of 70 mole % and an average grain size of 0.2 μm was obtained. (variation coefficient: 9%) <Preparation of Coated Sample>

To the thus obtained emulsion, there were added $5\times10^{-4}$ mole/mole Ag of Orthochromatic Sensitizing Dye (1) illustrated below to achieve orthochromatic sensitization. To the thus sensitized emulsion, there were further added hydroquinone and 1-phenyl-5-mercaptotetrazole in amounts of 2.5 g and 50 mg respectively per mole of Ag, a polyethylacrylate latex as a plasticizer in a proportion of 25 wt % to gelatin as the binder, 2-bis(vinylsulfonylacetamide)ethane as a hardener at a coverage ranging from 15 to 150 mg/m² per g of the whole gelatin so as attain the swelling degree shown in Table-1, and colloidal silica (Snowtex C, produced by Nissan Chemicals Industries Ltd.) at such a coverage as shown in Table-1. The thus prepared emulsion was coated on a polyester support so as to have a silver coverage of 3.0 g/m². In coating the emulsion, the upper and the lower protective layers having the individual compositions shown below were coated simultaneously.

Orthochromatic Sensitizing Dye (1)

-continued

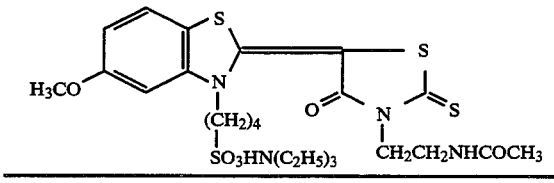

| | |
|---|---|
| Lower Protective Layer: | |
| Gelatin | 0.25 g/m² |
| Sodium benzenethiosulfonate | 4 mg/m² |
| 1,5-Dihydroxy-2-benzaldoxime | 25 mg/m² |
| Polyethylacrylate latex | 125 mg/m² |
| Upper Protective Layer: | |
| Gelatin | 0.25 g/m² |
| Silica matting agent (average grain size: 2.5 μm) | 50 mg/m² |
| Compound (1) (gelatin dispersion) | 30 mg/m² |
| Colloidal silica having grain size of 10 to 20 μm | 30 mg/m² |
| Compound (2) | 5 mg/m² |
| Sodium dodecylbenzenesulfonate | 22 mg/m² |

Compound (1)

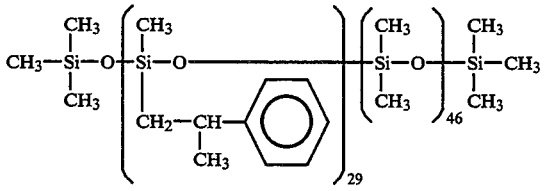

Compound (2)

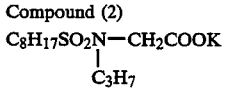

Additionally, the polyester support used had the following backing and back protecting layers.

| | |
|---|---|
| Backing Layer: | |
| Gelatin | 3 g/m² |
| Sodium Dodecylbenzenesulfonate | 80 mg/m² |
| Compound (3) | 70 mg/m² |
| Compound (4) | 85 mg/² |
| Compound (5) | 90 mg/m² |
| 1,3-Divinylsulfone-3-propanol | 60 mg/m² |

Compound (3)

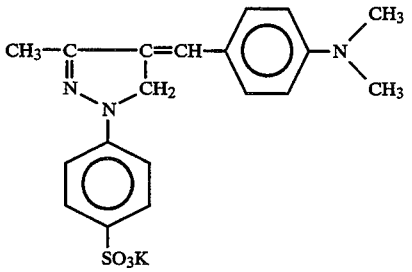

Compound (4)

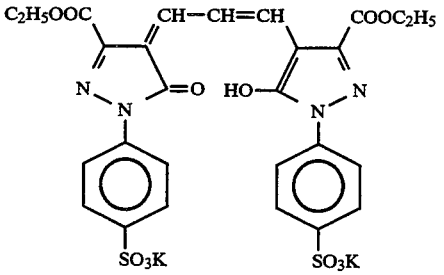

-continued

Compound (5)

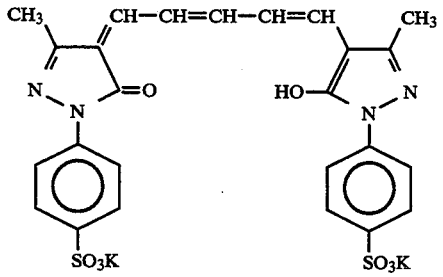

Back Protecting Layer:

| | |
|---|---|
| Gelatin | 0.5 g/m$^2$ |
| Polymethylmethacrylate (particle size: 4.7 μm) | 30 mg/m$^2$ |
| Compound (2) illustrated above | 2 mg/m$^2$ |
| Compound (1) illustrated above (gelatin dispersion) | 100 mg/m$^2$ |

The thus obtained samples were each allowed to stand for 1 week in the atmosphere of 25° C. and 60% RH, and examined for the following properties, thereby making evaluation of these samples.

(1) Total Swelling Degree of Emulsion Layers plus Protective Layers:

The total thickness of the emulsion layers and the protective layers before swelling was measured under a sensing pressure of 30±5 g with an electron micrometer made by Anritsu Electric Co., Ltd., and that after swelling was measured under a sensing pressure of 2±0.5 g with the same electron micrometer.

(2) Wet Film Strength;

Each sample was dipped in 25° C. distilled water for 5 minutes, and on the sample surface was pressed a sapphire stylus having a radius of 0.4 mm. The sapphire stylus was moved at a speed of 10 mm/sec as the load imposed on the stylus was continuously altered. Therein, the load (g) under which the sample was on the point of tearing was measured. Practically, wet strength of at least 90 g is required of a photographic film.

(3) Pressure Fog:

In the atmosphere of 25° C. and 60% RH, the surface of each sample was rubbed with a sapphire stylus having a diameter of 0.1 mm while the load imposed on the stylus was being increased continuously from 0 up to 200 g. Thereafter, the sample was developed with a developer No. 4 set forth in Table-2, and thereby was determined the load under which the generation of fog was observed. In practice, the generation of fog under a load of no heavier than 180 g is not allowed.

TABLE-1

| Sample No. | Total Swelling Degree* (%) | Colloidal Silica (g/m$^2$) | Wet Film Strength (g) | Pressure Fog (g) |
|---|---|---|---|---|
| 1 (comparison) | 250 | 0 | 70 | 15 |
| 2 (comparison) | 200 | 0 | 95 | 15 |
| 3 (comparison) | 150 | 0 | 100 | 15 |
| 4 (comparison) | 100 | 0 | 108 | 15 |
| 5 (comparison) | 250 | 0.4 | 70 | 190 |
| 6 (invention) | 200 | 0.4 | 95 | 190 |
| 7 (invention) | 150 | 0.4 | 100 | 190 |
| 8 (invention) | 100 | 0.4 | 108 | 190 |

* with respect to the emulsion layer and the protective layers.

Composition of Developer:

| | |
|---|---|
| Potassium hydroxide | 52.0 g |
| Diethylenetriaminepentaacetic acid | 3.0 g |
| Sodium metabisulfite | 60.0 g |
| Potassium carbonate | 18.0 g |
| Potassium bromide | 4.5 g |
| 5-Methylbenzotriazole | 0.1 g |
| Sodium 2-mercaptobenzimidazole-5-sulfonate | 0.22 g |
| Hydroquinone | 38.0 g |
| 4-Hydroxymethyl-4-methyl-1-phenyl-3-pyrazolidone | 0.7 g |
| Water to make | 1 l |
| Potassium hydroxide to adjust to pH | 10.7 |

Developers for the test use were prepared on the basis of the foregoing developer, as set forth in Table-2.

TABLE-2

| Developer No. | Compound (I) Compounds | Compound (I) Amount added | Compound (II) Compounds | Compound (II) Amount added | Compound(II)/HQ Ratio (by mole) |
|---|---|---|---|---|---|
| 1 (comparison) | — | — | — | — | — |
| 2 (comparison) | I-4 | 0.07 g/l | — | — | — |
| 3 (comparison) | — | — | II-1 | 3.75 g/l | 0.0625 |
| 4 (invention) | I-4 | 0.07 g/l | II-1 | 3.75 g/l | 0.0625 |
| 5 (invention) | I-3 | 0.06 g/l | II-3 | 4.50 g/l | 0.0710 |
| 6 (comparison) | I-4 | 0.07 g/l | II-1 | 0.75 g/l | 0.0125 |
| 7 (comparison) | I-4 | 0.07 g/l | II-1 | 9.01 g/l | 0.1500 |
| 8 (invention) | I-7 | 0.20 g/l | II-1 | 3.75 g/l | 0.0625 |

The fixer used was SR-F1 (products of Fuji Photo Film Co., Ltd.), and the replenishment rate thereof upon continuous processing was 180 ml per m$^2$ of the photographic materials processed therein.

The Samples Nos. 4, 7 and 8 set forth in Table 1 were each underwent the running test using the above-described developers respectively. After the continuous processing, each sample was examined for photographic properties, silver stain and color stain.

The term "continuous processing" used herein refers to the processing performed under a running condition such that the processing of 40 sheets per day of half-exposed Sample No. 4 having a Dai-Zen size (50.8 cm ×61.0 cm), 40 sheets per day of half-exposed Sample No. 7 having a Dai-Zen size and 40 sheets per day of half-exposed Sample No. 8 having a Dai-Zen size was continued for 6 days and then suspended for one day, which was taken as one round of processing, and three rounds of processing were carried out. The replenishment rates of the processing solutions were each 150 ml per $m^2$ of the photographic materials processed therein.

An evaluation of the sensitivity as one photographic characteristic was made in the following manner:

Each sample was exposed by means of a Xenon flash lamp having a light emission time of $10^{-6}$ second through an interference filter having a peak at 488 nm and a continuous wedge, and then processed with different developers. A standard sensitivity was defined by the reciprocal of the exposure amount required for obtaining a density of 1.5 when each sample was developed with each fresh developer. The sensitivities examined after the continuous processing with different developers are shown in Table-3 as relative values, with the standard sensitivity being taken as 100.

The silver stain generated in the last stage of the foregoing continuous processing was examined by visual observation, and an evaluation was made in five grades as follows: The state such that silver stain was not observed at all on the films processed, in the developing tank and on the rollers was evaluated as the grade "5" and, on the other hand, the state such that silver stain was observed over the whole surfaces of the films processed and a good deal of silver sludge was generated in the developing tank and on the rollers was evaluated as the grade "1". The grade "4" meant the state such that no silver stain was observed on the films processed, while slight silver sludge was generated in the developing tank and on the rollers, but the quantity of the silver sludge was on a practically allowable level. The grades "3" and "2" meant the state problematic from the practical point of view and the state on an impractical level, respectively.

The term "color stain" used herein signifies the dyes and the sensitizing dyes remaining on photographic films after the films are processed with an automatic developing machine (abbreviated as an auto processor hereinafter), which become a serious problem in the graphic arts.

The color stain was examined by visual observation, and an evaluation was made in five grades as follows: The state such that color stain was not observed at all on the films processed was evaluated as the grade "5", and, on the other hand, the state such that color remained on the whole surfaces of the films processed was evaluated as the grade "1". The grade "4" meant the state such that slight color stain was generated on the films processed but the extent thereof was on a practically allowable level. The grades "3" and "2" meant the states problematic from the practical point of view.

The auto processor used for the running test was FG-710S (made by Fuji Photo Film Co., Ltd.), and the development temperature and time adopted therein were 38° C. and 12.3"respectively.

The results obtained by the foregoing running test are shown in Table-3.

TABLE-3

| Test No. | Developer No. | Sample No. | Sensitivities upon running operation fresh | Sensitivities upon running operation last | Silver stain | Color stain |
|---|---|---|---|---|---|---|
| 1 (comparison) | 1 | 8 | 100 | 96 | 2 | 2 |
| 2 (comparison) | 2 | 8 | 100 | 97 | 5 | 2 |

TABLE-3-continued

| Test No. | Developer No. | Sample No. | Sensitivities upon running operation fresh | Sensitivities upon running operation last | Silver stain | Color stain |
|---|---|---|---|---|---|---|
| 3 (comparison) | 3 | 8 | 100 | 98 | 2 | 4 |
| 4 (invention) | 4 | 8 | 100 | 100 | 5 | 5 |
| 5 (invention) | 5 | 8 | 100 | 98 | 4 | 4 |
| 6 (comparison) | 6 | 8 | 100 | 88 | 4 | 3 |
| 7 (comparison) | 7 | 8 | 100 | 85 | 5 | 4 |
| 8 (invention) | 8 | 8 | 100 | 98 | 4 | 5 |
| 9 (comparison) | 4 | 4 | 100 | 100 | 5 | 4 |
| 10 (comparison) | 5 | 4 | 100 | 98 | 4 | 4 |
| 11 (comparison) | 8 | 4 | 100 | 98 | 4 | 4 |
| 12 (invention) | 4 | 7 | 100 | 100 | 5 | 5 |
| 13 (invention) | 5 | 7 | 100 | 99 | 4 | 5 |

As can be seen from Table-1 and Table-3, the processing system according to the embodiments of the present invention was advantageous in that the present samples were superior in both wet film strength and pressure fog resistance and, when they were used in combination with the present developers, not only silver stain but also color stain was reduced.

EXAMPLE 2

Samples were prepared in the same manner as in Example 1, except that the orthochromatic sensitizing dye was replaced by the following dye. The amount of the dye added was $1\times10^{-4}$ mole/mole Ag.

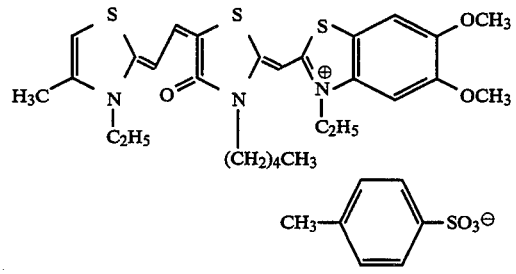

In analogy with Example 1, the thus prepared samples were examined for physical properties as films, and then underwent the running test using the same developers as used in Example 1. (However, the interference filter having a peak at 633 nm was used in evaluating the photographic characteristics.)

Therein, the same results as in Example 1 were obtained. That is, the samples prepared in accordance with the present invention had high wet-film strength and were hard to generate pressure fog, and further the silver stain and the color stain were reduced when the present samples were used in combination with the developers according to the present invention.

While the invention has been described in detail and with reference to specific embodiments thereof, it will be apparent to one skilled in the art that various changes and modifications can be made therein without departing from the spirits and scope thereof.

What is claimed is:

1. A method for processing silver halide photographic materials having a support having thereon at least one silver halide emulsion layer and at least one protective layer provided over said emulsion layer in which each of the photographic materials contains colloidal silica in at least one emulsion layer and is at most 200% in the total swelling degree of the whole hydrophilic colloid layers provided on the side of said emulsion layer, and after optical exposure said photographic materials are developed with a developer adjusted to pH 9.5–12.0 and containing at least (1) a hydroquinone developing agent in a concentration of from 0.2 to 0.75 mole/l, (2) an auxiliary developing agent of 1-phenyl-3-pyrazolidone type and/or an auxiliary developing agent of p-aminophenol type in a concentration of from 0.001 to 0.06 mole/l, (3) free sulfite ions in a concentration of from 0.3 to 1.2 mole/l, (4) a compound represented by the following formula (I), and (5) a compound represented by the following formula (II) in a concentration bearing a ratio of from 0.03 to 0.12 to the concentration of the hydroquinone developing agent:

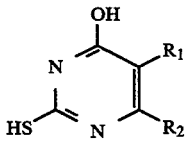

(I)

wherein $R_1$ and $R_2$ each represent a hydrogen atom, an alkyl group, an aryl group, an aralkyl group, a hydroxyl group, a mercapto group, a carboxyl group, a sulfo group, a phosphono group, an amino group, a nitro group, a cyano group, a halogen atom, an alkoxycarbonyl group, an aryloxycarbonyl group, a carbamoyl group, a sulfamoyl group or an alkoxy group, or $R_1$ and $R_2$ may combine with each other to complete a ring structure;

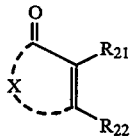

(II)

wherein $R_{21}$ and $R_{22}$ each represent a hydroxy group, an amino group, an acylamino group, an alkylsulfonylamino group, an arylsulfonylamino group, an alkoxycarbonylamino group, a mercapto group or an alkylthio group, and X is constituted of carbon, oxygen or/and nitrogen atoms and forms a 5- or 6-membered ring together with the vinyl group's two carbon atoms to which $R_1$ and $R_2$ are attached and the carbonyl group's carbon atom.

2. The processing method of claim 1, wherein the silver halide emulsions are spectrally sensitized.

3. The processing method of claim 1, wherein the compound of formula (I) is contained in an amount of from 0.01 to 100 m mole per liter of the developer.

4. The processing method of claim 3, wherein the compound of formula (I) is contained in an amount of from 0.1 to 10 m mole per liter of the developer.

5. The processing method of claim 1, wherein the ratio of the concentration of the compound of formula (II) to that of the hydroquinone developing agent is in a arrange of 0.03 to 0.10.

6. The processing method of claim 5, wherein the ratio of the concentration of the compound of formula (II) to that of the hydroquinone developing agent is in a range of 0.05 to 0.09.

7. The processing method claim 1, wherein the total swelling degree of a whole hydrophilic colloid layers ranges from 50 to 150%.

8. The processing method of claim 1, wherein a ratio of a colloidal silica to gelatin used as a binder in the layer to which the colloidal silica is added, ranges from 0.05 to 1.0 on a dry weight basis.

* * * * *